US005965049A

United States Patent [19]

Carlet

[11] Patent Number: 5,965,049

[45] Date of Patent: Oct. 12, 1999

[54] SELF-REGULATING ELECTRIC HEATING ELEMENT FOR HEATERS SHAPED AS CARTRIDGES OR TEST TUBES

[76] Inventor: Ennio Carlet, Via S. Urbano n. 9, 31010, Godega di S. Urbano (Treviso), Italy

[21] Appl. No.: 08/892,435

[22] Filed: Jul. 14, 1997

[30] Foreign Application Priority Data

Jul. 18, 1996 [IT] Italy ..... TV96A0091

[51] Int. Cl.[6] ..... H05B 1/02

[52] U.S. Cl. ..... 219/505; 219/543; 219/538; 219/546; 219/548; 219/552; 338/22 R

[58] Field of Search ..... 219/505, 504, 219/548, 552, 553, 546, 543, 538; 338/22 R, 225 C

[56] References Cited

U.S. PATENT DOCUMENTS

| | | | |
|---|---|---|---|
| 4,266,115 | 5/1981 | Dannatt | 219/216 |
| 4,354,092 | 10/1982 | Manabe et al. | 219/505 |
| 4,379,220 | 4/1983 | Middleman et al. . | |
| 4,654,511 | 3/1987 | Horsma et al. | 219/548 |
| 5,084,694 | 1/1992 | Kikuchi et al. | 338/308 |
| 5,354,965 | 10/1994 | Lee | 219/202 |

FOREIGN PATENT DOCUMENTS

| | | |
|---|---|---|
| 0198598 | 10/1986 | European Pat. Off. . |
| 8805681 | 7/1988 | Germany . |
| 4445949 | 6/1996 | Germany . |
| 2084437 | 4/1982 | United Kingdom . |
| 9531882 | 11/1995 | WIPO . |

*Primary Examiner*—Mark Paschall
*Attorney, Agent, or Firm*—Bucknam and Archer

[57] ABSTRACT

An electric resistance heating element preferably of cylindrical or prismatic shape to be inserted into a test tube, a cartridge or in another cavity has one or more conductors connected to the supply system by the use of one or more electrodes. The conductors are made of a conductive composite material of a polymeric matrix with resistive function which are formulated at such ratio and materials as to achieve an electric resistance with high positive temperature coefficient (PTC) at the operation temperatures. The electrodes may be made of metallic materials. At least a core is made of insulating material, onto which the conductors with resistive function (PTC) and the electrodes are applied.

7 Claims, 3 Drawing Sheets

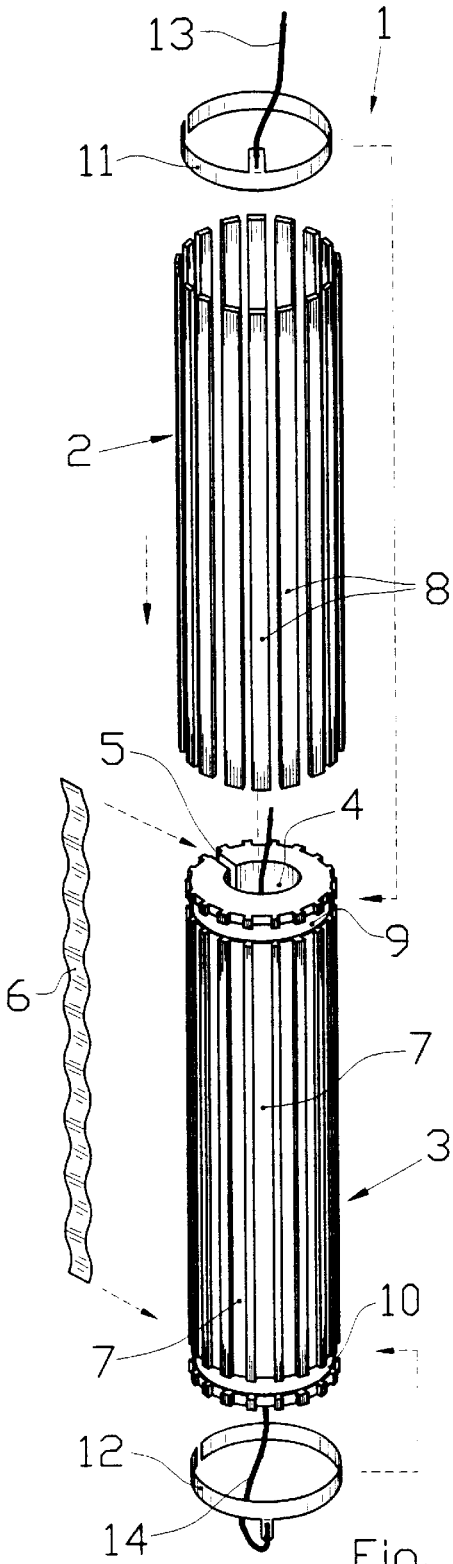
Fig. 1
Fig. 2
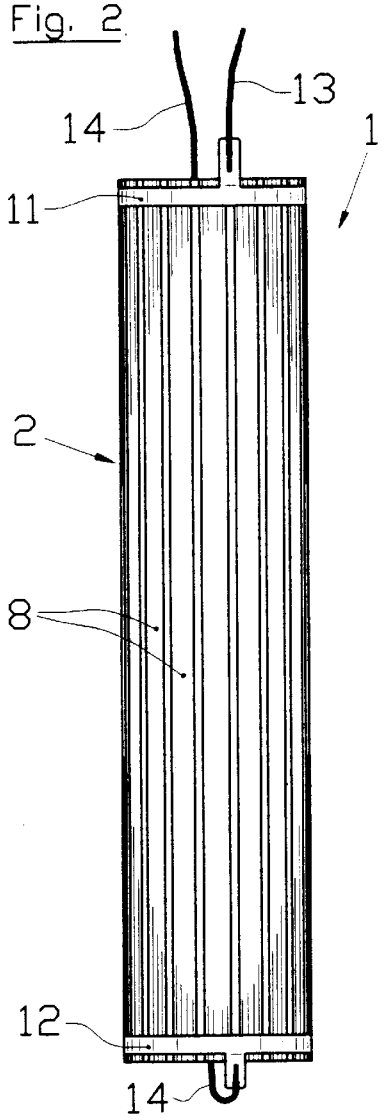
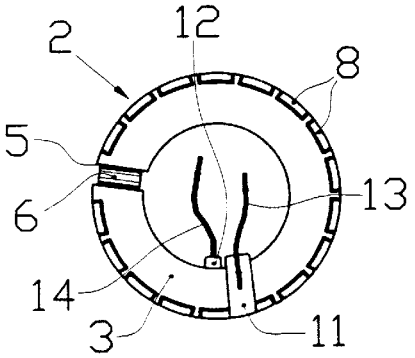
Fig. 2a

SELF-REGULATING ELECTRIC HEATING ELEMENT FOR HEATERS SHAPED AS CARTRIDGES OR TEST TUBES

FIELD OF THE INVENTION

The present invention relates to an electric heating element, namely a self-regularing joule-effect heating body having a cylindrical or prismatic outer form which can be inserted mainly but non-exclusively in a cartridge or a test tube.

BACKGROUND OF THE PRIOR ART

The electric heaters shaped as test tubes are generally provided with an envelope which is similar for the different uses thereof which are different for the kind of heating element namely heater contained therein. The same can be said for electric heaters shaped as cartridges. Such heaters shaped as test tubes are generally provided with an envelope made of insulating material (normally glass, but also any other insulating material) and have the form of a cylinder with a bottom which is closed by the same material of the cylindrical part thereof, or by a plug. The heating element of the currently used test tubes is generally formed of one or more spirals or windings made of alloys for resistances (for example, NiCr) which are positioned on a core made of ceramic material or mica. Recently, there have appeared in the field of aquarium appliances some kinds of test tubes with a hearing element based on a self-regulating thick film resistance with FTC effect. This technology, which has been used in electronic engineering since several decades in the field of hybrid circuits, consists of producing a circuit by applying one or more conductor inks on a support constituted by a polymeric film, which is then pressed against the test tube inner surfaces However, such technology has the following main drawbacks: high scattering of resistance values of the heating elements of the same lot, due above all to the difficulty of providing a uniform layer thereof, high production costs, the manufacturing process not very clean from the ecological point of view The cartridge heaters are provided with a metallic outer envelope, a cartridge, and made with a cylindrical form, as usual, and also with different prismatic forms.

A most diffused heating element is that constituted by a metallic spiral immersed in the compact magnesium oxide, as in the case of the armored resistances.

A kind of heating element which at the present has a certain diffusion is the PTC (positive temperature coefficient) element with self-regulating characteristics based on ceramic pellets (doped barium titanate). Some constructive products of this kind, having also envelopes made of special materials such as for instance siliconic rubbers filled with large amounts of conductive ceramic powders are provided. The drawbacks of this kind of resistance are: cost and high scattering of resistance values of the single pellets.

SUMMARY OF THE INVENTION

The present invention relates to an electric heating element of the self-regulating type based on a resistance made of composite material with cylindrical or prismatic outer form which can be inserted in a test tube, a cart-ridge or a cavity of the product to be heated or a product adjacent thereto and which is shaped with a negative form with respect to this latter as it will be described hereinafter.

A single embodiment of the invention will be represented by the following description with reference to the attached drawings, wherein:

FIG. 1 shows an exploded perspective view of a not-limiting embodiment of the present heating element;

FIG. 2 and 2A show a front and a plan view of the heating element of FIG. 1;

Figure 7A:
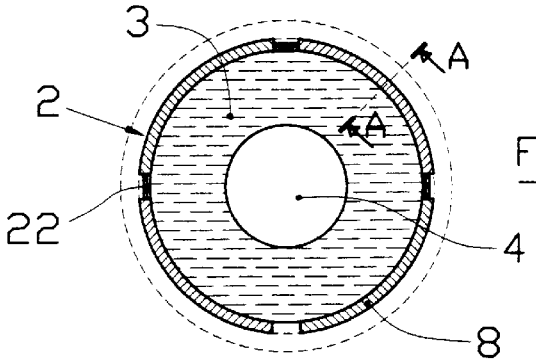
Figure 7B:
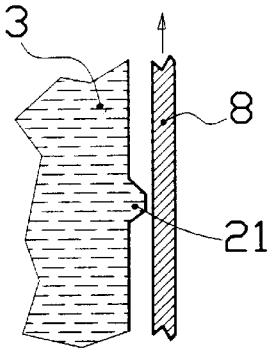
Figure 7C:
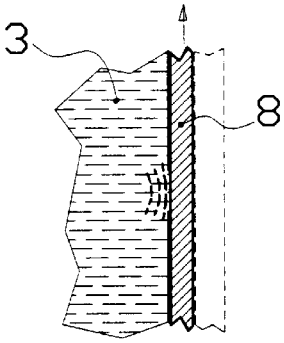
Figure 7D:
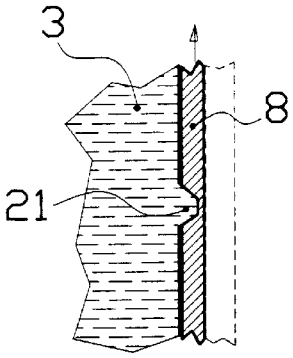
Figure 7E:
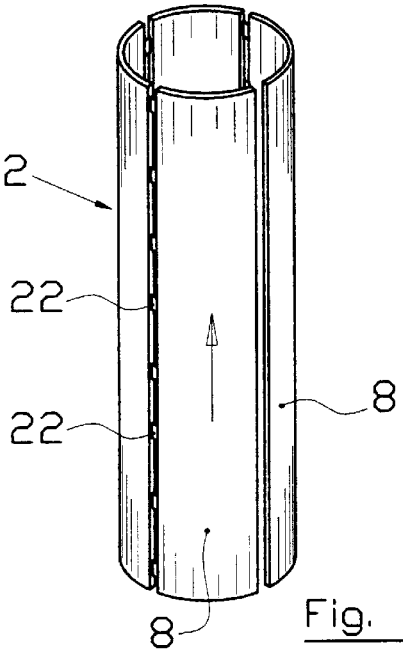

FIG. 7*a* shows a cutaway view of an element similar to that one of FIG. 1 in which, however, the core is made in a different manner;

FIGS. 7*b*, 7*c* and 7*d* show the element of FIG. 7*a* in three different operating modes thereof;

FIG. 7*e* shows a component part of the element of FIG. 7*a;*

Figure 8:
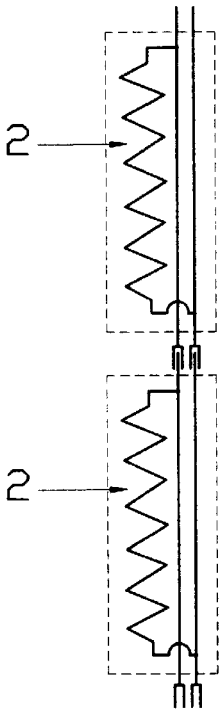

FIG. 8 shows a possible arrangement of two elements as illustrated by the FIGS. 7*a*–7*e*.

With reference to FIGS. 1 and 2, a heating element 1 having cylindrical body with resistive conductors 2 made of composite material with PTC characteristics and extended in a longitudinal direction is illustrated, which heating element is arranged on a core 3 provided with a single longitudinal hole 4 for the passage of a supply cable and a longitudinal slot 5, permitting a resilient element 6 to be inserted therein for being expanded.

The core 3 is provided with longitudinal slots 7 for housing the resistive conductors 8 and two slots 9 and 10 at its outer periphery for housing the two electrodes 11 and 12, which are made preferably as an open annular metallic foil for permitting the heating element expansion, and which are disposed outside the resistive conductors 8 and connected to the supply conductors 13 and 14. The resistive conductors 8 are constituted by a suitable conductive composite material with self-regulating characteristics, and particularly by an electric conductive filler, one or more conductive powders such as carbon black, graphite, silver etc, the polymeric binder, one or more polymers such as polyethylene, polyamides, thermoplastic polyesters, acetal resins, PEEK, PES, PPS etc. and possible additional additives and/or not-conductive fillers providing for special physical-chemical characteristics of the so obtained composite material, such as plasticizers, inert fillers, lubricants, stabilizers etc.

It is known that a composite material formed by a polymer and micrometric particles of electric conductive material which are closely mixed together has a resistivity value which decreases with the volume ratio of the electric conductive particles and which shows a strongly positive TCR (temperature coefficient of the resistance) at a particular range of the composition of the composite materials, the so-called percolation range. By disregarding the physical aspects which are known from the theory which explain the manifestation of a remarkable PTC effect, is evident that by employing different materials such as binders (polymers), electric conductive fillers (particles) and particles it is possible to obtain composite materials having electric resistivity, temperature coefficient (FTC) and thermal-physical characteristics which can be defined in advance. The resistive conductors made of the so formulated composite material at a certain temperature present a high output reduction due to a high resistance increase (PTC output reduction due to a high resistance increase (PTC effect), which fact provides for self-regulating the temperature of the heating element.

Table 1 describes two not-limiting examples of materials suitable for this purpose. It is evident that also different combinations of materials according to the described principles and mixtures of the so formulated composite materials can be employed for most different uses.

Table 1—Examples of formulation of composite materials for the resistive conductors.

EXAMPLE 1

Figure 5:
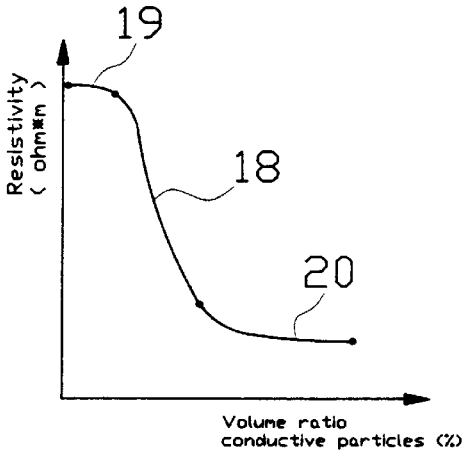
FIG. 5 shows the typical behavior of the electric resistivity on the volume ratio of conductive particles of a composite material with polymeric binder and filler formed by conductive particles.

Material with self-regulating characteristics
Composition
HD Polyethylene (High Density Polyethylene): 65% volume, Carbon black powder: 28% volume, wherein this main conductive filler is formed by Carbon black powder of RCF-type with middle BET (surface area) and low particle size used in the zone 18 of the diagram of FIGS. 5, referred to the system formed by the present HD-FE and carbon black, Graphite powder: 7% volume, wherein this filler is a secondary conductive filler formed by graphite with average granulometry of 4 $\mu$m, whose function is to increase the conductivity and improve the heat flow of the composite material, Titanium dioxide: 1% volume.

EXAMPLE 2

Material with zero temperature coefficient (No PTC effect), Composition
Thermoplastic polyester: 69% volume, Carbon black powder: 27% volume, which is the main conductive filler formed by Carbon black powder of RCF type (with conductive grade), with low absorption, middle BET (surface area) and low particle size used in the zone 20 of the diagram of FIG. 5.

Carbon black pellets: 2,5% volume, which is a secondary conductive filler formed by Carbon black pellets of RCF type (extra conductive grade), high absorption, high BET (surface area) and middle particle size.

The resistive conductors are obtained by submitting the described material to the conventional forming processes of plastic materials, namely extrusion, injection molding, thermoforming etc. Such conductors can be made directly onto the core of the hearing element or also separately as strips or shaped with other forms, which are subsequently assembled onto the core by means of glueing, heat seal, or simply by applying mechanical pressure between the core and the envelope where the element must be disposed, a test tube, cartridge or the like.

The resistive conductors can be made with constant or anyhow variable cross-section. A variable cross-section may permit to attain a differentiated heating or a wider contact with the electrodes. The different resistive conductors may be separated or each one of them can be joined to another one by means of bonds of the same material, so as to form a single body made preferably by injection molding and preferably open along a generating line, thereby permitting a limited expansion of the resulting sleeve.

The resistive part of composite material, can be made on an embodiment thereof with a single conductor, which provides for a sleeve, preferably open longitudinally along a generating line, thereby permitting a limited expansion of the resulting sleeve.

The resistive part of composite material can be made on an embodiment thereof with a single conductor, which provides for a sleeve, preferably open longitudinally along a generating line of resistive material arranged around the core.

The conductors with resistive function made of composite material are powered by two or more electrodes, whose number, arrangement, location and type may vary.

The electrodes may be made of metallic material shaped as foils, plates, wires, cables, by utilizing any other material having a good electric conductivity, including electroconductive composite materials, electroconductive paints or inks, metallized parts.

A possible constructive solution is also the direct use of the supply cables as electrodes.

No matter how the electrodes are made, the contact with the resistive conductors can be obtained indifferently outside and inside, that is electrodes embedded on the resistive conductors or electrodes arranged between the core and the resistive conductors. The conductors with resistive function and the electrodes are located onto a core of insulating material. As not-limitative examples of materials with which the core may be made are: polymers and elastomers with different amounts and types of fillers, ceramic, glass. Generally, any material or combination of insulating materials may be employed. The core is provided at its outer surface with slots providing for housing the conductors with resistive function and the associated electrodes. The slots serve for housing the composite conductors and centering the core in the course of the manufacturing process, in particular when the composite conductors are applied, which fact, however, does not exclude that the composite conductors can be arranged simply onto the insulating core not provided with slots.

The shape of the entire heating element and therefore of the core forming the base thereof may be cylindrical, as commonly for the heaters shaped as cartridges, test tubes, or prismatic with any polygonal cross-section. The core central portion may be provided with one or more longitudinal through holes and/or cavities (not indicated) permitting one or more cables or electric conductor of other kind to pass therethrough, blind or through holes and/or cavities (not indicated) with different positions for housing some sensors, safety devices, regulating devices or the like.

In accordance to another characteristic of the invention, the core may be made, by exploiting the elasticity of its constructive material, such as for example a siliconic elastomer and/or by employing some additional rigid or resilient mechanical elements 6 such as for example a longitudinal metallic spring which is inserted in a proper slit provided along the entire core length in such a way as to be forced radially therein once the heating element is introduced in the test tube, cartridge or other suitable seat thereby causing the thermal contact resistance between the heating element, which may be wound on a film or insulating paper or the like and the wall of the envelope into which it is contained, a test tube, a cartridge or the like to be minimized.

As already stated, the heating element conductive portion is formed by a portion formed by a plurality of conductors, or only a conductor with resistive function and made of composite material devoted to heat generation and a portion connected to an electric supply and made typically but not exclusively of metallic material, that is the electrodes.

The electric connection between these two portions may be made in different manners.

Schematically, such arrangements can be the following:

axial current flow in the resistive portion and electrodes with circumferential extent, circumferential current flow in the resistive portion and electrodes with longitudinal extent, combination of the two previous cases with current flow with an axial and a circumferential component, for example a resistive portion forming a helical path with steady or variable pitch.

Figure 3:
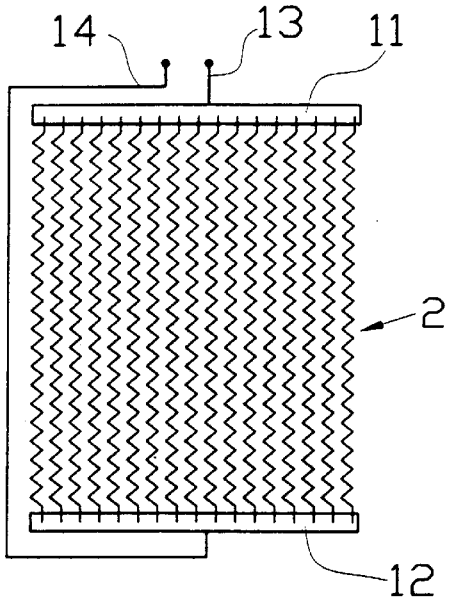
FIG. 3 shows the electric wiring diagram of the heating element of FIG. 1.
Figure 4:
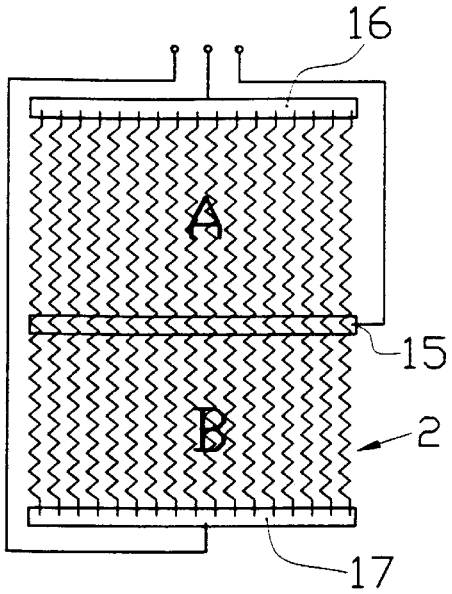
FIG. 4 shows the electric wiring diagram of a heating element similar to that one of FIG. 1.

Such connection is illustrated in FIG. 3 showing the electric wiring diagram of the electrodes and the resistive conductors of the heating element of FIGS. 1 and 2 and 4 showing the electric wiring diagram of the electrodes and the resistive conductors of a heating element similar to that one of FIG. 1, in which however a third intermediate electrode 15 is connected. Such an arrangement may be supplied with DC or monophase AC so as to permit to decrease the resistance of the element connected thereto, in particular of the zones A and B in which the two extreme electrodes 16 and 17 are connected to each other, and to obtain an element with more power levels by means of a selector, not indicated, permitting the zones A and B to be supplied in series, in parallel or separately to each other. A differentiated output of the zones A and B may be obtained by arranging the intermediate electrode 15 at a not central position thereof and connecting in parallel the two zones A and B.

The present heating element, as the other heating elements used at the present inside test tubes or cartridges may occupy either the entire space available in the envelope or a part thereof only, in the case in which an accurate temperature adjustment device, for example a bimetallic thermostat, an electronic thermostat and/or a safety system (for example a fuse) must be inserted therein. One of these adjustment or safety components may be inserted also inside the insulating core, into specific cavities thereof as already explained. The present heating element may be completed also with other component parts performing auxiliary functions.

The heating element according to the invention is insulated electrically, when it is inserted in a metallic cartridge or a metallic sear, with the interposition of a polymeric dielectric film, an insulating paper or other electric barrier. The same type of electric barrier is applied on the test tubes when a double wall insulation is required.

With reference to FIG. 5 shown therein is the typical behavior of the electric resistivity on the volume ratio of conductive particles of a composite material with polymeric binder and filler formed by conductive particles. In order to achieve the PTC effect, a filler percentage on the zone 18, percolation zone, must be chosen. A very low electric conductivity is achieved on the zone 20.

Figure 6:
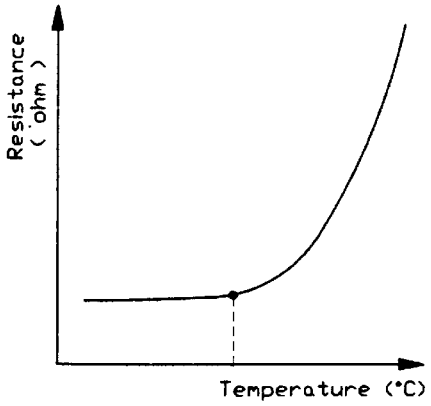
FIG. 6 shows the resistance change on the temperature (PTC effect) of an electric conductor formed by a composite material with polymeric binder and filler formed by conductive particles at a suitable ratio thereof.

With reference to FIG. 6 shown therein is the resistance change on the temperature (PTC effect) of an electric conductor formed by a composite material with. polymeric binder and filler formed by conductive particles at a suitable ratio thereof (see zone 18 of FIG. 5).

Such heating element may be used in combination with heating test tubes for aquarium apparatuses, test tubes for heating photographic or chemical baths, cartridges for all uses with middle-low specific power, output/cartridge surface and the like.

Turning now to the FIGS. 7*a*–7*e* showing a core of the present element made in another manner, there is represented a core 3 made of elastomer material, which is not provided with slots for housing the resistive conductors, but it is provided with some peripheral and radially protruding ribs 21, which are orthogonal to the electric current flow, whose height is almost equal to the thickness of the resistive conductors 2, which during the assembling of the conductors on the core are squashed inward by the pressure of the envelope against the resistive conductors, from the position of FIG. 7*b* to the position of FIG. 7*c*. In case of an overheating of the resistive conductors, these latter soften and melt, so that the ribs 21 expand against the resistive conductors and "throttle" them (see FIG. 7*d*), and therefore, by means of this mechanical action, increase the electrical resistance thereof and improve the operating safety of the assembly. FIG. 7*e* shows the resistive conductors of the element of FIG. 7*a,* in this case formed by four conductors, which are made integrally and connected to each other by some bonds 22 of the same material, except the first and the last conductors, so as to permit a limited expansion of the assembly.

Finally, FIG. 8 shows two identical modular shaped elements of the kind referred to, which can be coupled inside the same envelope (for example, a test tube), 60 as to attain an output which is multiple of that of a single module. In this case, an inner wiring permitting the needed parallel connection thereof is shown. In this way, modules which are identical may be utilized for each envelope (cartridges or test tubes) for different output ranges, as in the case of heaters for aquariums.

The advantages offered by the present invention can be summarized as follows:

the heating element according to the invention has a monolithic construction with respect to the current elements, permitting a quick and simple introduction thereof in the test tube or cartridge and therefor an easy automatic assembling thereof.

An intrinsic power and therefore temperature self-limitative capacity of the heating element, due to the considerable positive temperature coefficient (PTC) of the resistance, deriving from the special composite material utilized for the resistive portion.

The utilized conductive composite material may be so formulated as to achieve volume resistivity, PTC curve and max. temperature of use which are variable on a wide range.

The beating element referred to may be manufactured by exploiting simple and proven technologies which are widely used for manufacturing products made of plastic materials.

The manufacturing simplicity of the present heating element insures a low scattering of the resistance values with respect to other PTC resistances used at the present.

The thermal resistance between the heat generating area with conductors made of resistive composite materials and the envelope, test tube, cartridge or the like, is minimized, since the heat generating area is situated on the heating element surface, which fact involves limited thermal heads and therefore outputs at low temperature levels on the resistive portion In the case in which the core is made of an elastomer material, a mechanical system for "throttling" the resistive conductors can be provided so as to improve the safe operation of the present element.

I claim:

1. An electric resistance heating element for heaters shaped as cartridges or test tubes, comprising a plurality of resistive conductors (2,8) connected to an electric supply by a system of electrodes (11, 12, 16, 17) and at least a core (3), said core being made of electric insulating material, said resistive conductors (2, 8) being applied to said core, said resistive conductors (2, 8) being formed of a mixture of a polymeric binder, an electric conductive filler, constituted by a conductive powder in the form of micrometric particles, said powder being carbon black, graphite or silver, said mixture having an electrical resistance with high positive temperature coefficient (PTC) at the operation temperatures, wherein said resistive conductors (2, 8) are formed as strips applied onto said core (3), wherein said electrodes (11, 12, 16, 17) are made of metallic materials in the form of foils, plates, wires, cables, said metallic materials including conductive coating layers consisting of inks or paints, said electrodes being disposed on said core (3), and wherein said core (3) is provided with at least a longitudinal internal hole (4) for the passage of a supply cable or electric conductors, and a longitudinal slot (5) for the entire length thereof, whereby said core (3) is caused to be expanded for being introduced into a test tube or cartridge, and wherein said resistive conductors (2, 8) are disposed on said core (3) with such an arrangement as to permit the electric current to flow axially, circumferentially or helically with respect to the core extent.

2. The heating element according to claim 1 wherein said binder is a thermoplastic material.

3. The heating element according to claim 1 wherein said core is expanded with the interposition of an electrical insulating material.

4. The heating element according to claim 1, wherein said mixture of said resistive conductors comprises an additive consisting of a not-conductive filler, said non-conductive filler being a plasticizer, an inert filler, a lubricant or a stabilizer.

5. An electric resistance heating element for heaters shaped as cartridges or test tubes, comprising a plurality of resistive conductors (2, 8) connected to an electric supply by a system of electrodes (11, 12, 16, 17) and at least a core (3), said core being made of electric insulating material, said resistive conductors (2, 8) being applied to said core, said resistive conductors (2, 8) being formed of a mixture of a polymeric binder, an electric conductive filler, constituted by a conductive powder in the form of micrometric particles, said powder being carbon black, graphite or silver, said mixture having an electrical resistance with high positive temperature coefficient (PTC) at the operation temperatures, wherein said electrodes (11, 12, 16, 17) are made of metallic materials in the form of foils, plates, wires, cables, said metallic materials including conductive coating layers consisting of inks or paints, said electrodes being disposed on said core (3) wherein said core (3) is made of an elastomer material and is provided with peripheral and radially protruded ribs (21), the height of said ribs being almost equal to the thickness of said resistive conductors (2, 8), said ribs (21) being squashed inwardly by said resistive conductors (2, 8) during the assembling of said resistive conductors (2, 8) on said core (3).

6. The heating element according to claim 5 wherein said cartridge or test tube is used for aquarium apparatuses and photographic or chemical baths.

7. The heating element according to claim 1 which is inserted into a test tube or a cartridge by interposing one or more dielectric film or other insulating material.

* * * * *